US007222949B2

(12) United States Patent
Ichihashi et al.

(10) Patent No.: US 7,222,949 B2
(45) Date of Patent: May 29, 2007

(54) METHOD FOR MANUFACTURING LIQUID CARTRIDGE AND A LIQUID CARTRIDGE

(75) Inventors: Akira Ichihashi, Nagano-ken (JP); Kenji Ito, Nagano-ken (JP); Yuichi Seki, Nagano-ken (JP); Satoshi Shinada, Nagano-ken (JP); Yasuto Sakai, Fukui-ken (JP); Taku Ishizawa, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 268 days.

(21) Appl. No.: 10/726,827

(22) Filed: Dec. 2, 2003

(65) Prior Publication Data

US 2004/0165042 A1 Aug. 26, 2004

(30) Foreign Application Priority Data

Dec. 10, 2002 (JP) ..... 2002-358763
Jul. 31, 2003 (JP) ..... 2003-204740

(51) Int. Cl.
*B41J 2/175* (2006.01)

(52) U.S. Cl. ..... 347/86

(58) Field of Classification Search ..... 347/84, 347/85, 86, 87; 604/88, 256, 264; 277/345
See application file for complete search history.

(56) References Cited

U.S. PATENT DOCUMENTS 4,729,396 A 3/1988 Kelly et al.
5,721,576 A * 2/1998 Barinaga ..... 347/85
5,781,213 A * 7/1998 Ujita et al. ..... 347/86
6,170,939 B1 * 1/2001 Ujita et al. ..... 347/86
6,186,620 B1 * 2/2001 Hsieh et al. ..... 347/84

(Continued)

FOREIGN PATENT DOCUMENTS

JP 05-229137 A 9/1993

(Continued)

OTHER PUBLICATIONS

Office Action in Japanese patent application 2003-204740, dated Sep. 14, 2005.

(Continued)

*Primary Examiner*—Anh T. N. Vo
(74) *Attorney, Agent, or Firm*—Stroock & Stroock & Lavan LLP

(57) ABSTRACT

A method for assembling an ink supply section having a supply valve for allowing an ink supplying opening and an ink containing chamber to communicate with each other by allowing the ink containing chamber, the ink supplying opening and an ink supply needle to be in contact with each other, a seal member for closing the ink supplying opening and the ink containing chamber by allowing the supplying valve to be in contact, and an urging member for urging the supply valve to the seal member, wherein the method includes the steps of inserting the urging member into the ink supply section from the ink supplying opening, mounting the seal member onto the ink supplying opening and allowing the supply valve to be in contact with the seal member by the urging force of the urging member by inserting the supply valve from the insertion opening of the seal member mounted on the supplying opening in the step of mounting.

6 Claims, 11 Drawing Sheets

U.S. PATENT DOCUMENTS

| | | | | |
|---|---|---|---|---|
| 6,612,689 | B2 * | 9/2003 | Suenaga et al. | 347/85 |
| 6,634,738 | B1 * | 10/2003 | Shinada et al. | 347/86 |

FOREIGN PATENT DOCUMENTS

| | | | |
|---|---|---|---|
| JP | 06-210869 | A | 8/1994 |
| JP | 2676076 | B2 | 3/1996 |
| JP | 08-119305 | A | 5/1996 |
| JP | 08-183185 | A | 7/1996 |
| JP | 11-170564 | A | 6/1999 |
| JP | 2001-113723 | A | 4/2001 |
| JP | 2001-341324 | A | 12/2001 |
| JP | 2002-17835 | A | 1/2002 |

OTHER PUBLICATIONS

Office Action in Japanese Patent Appln. 2003-205038 (Jun. 6, 2006).

* cited by examiner

METHOD FOR MANUFACTURING LIQUID CARTRIDGE AND A LIQUID CARTRIDGE

The present application claims priority from Japanese Patent Applications 2002-358763 filed on Dec. 10, 2002 and 2003-204740 filed on Jul. 31, 2003, the contents of which are incorporated herein by reference.

BACKGROUND OF THE INVENTION

1. Field of the Invention

The present invention relates to a method for manufacturing a liquid cartridge and a liquid cartridge. More particularly, the present invention relates to a method for manufacturing a liquid cartridge and a liquid cartridge, which has a supply valve in a liquid supplying part.

2. Description of the Related Art

The ink cartridge holds ink therein and supplies the ink held therein to a recording head of an inkjet type recording apparatus when mounted onto a carriage equipped with the recording head. In the ink cartridge, a supply valve and a seal member for being in contact with the supply valve are provided in an ink supply section into which an ink supply needle of the inkjet type recording apparatus is inserted. In a state where the ink cartridge is not mounted on the carriage, the supply valve seals the seal member so that the ink does not leak out from the ink cartridge. In addition, in a state where the ink cartridge is mounted on the carriage, since the ink supply needle of the inkjet type recording apparatus moves the supply valve, the supply valve opens the seal member, and thus the ink is supplied to the recording head. For example, as a supply valve of the ink cartridge, a ball valve has been used as disclosed in Japanese Patent Application Publication No. 5-229137. Further, the ink cartridge, the inkjet type recording apparatus and the recording head here are an example of the liquid cartridge, the liquid ejecting apparatus and the ejecting head.

However, in the ball-shaped supply valve, there is a possibility that the ink supply needle is not always in contact with the center part of the ball-shaped supply valve, so, in this case, the supply valve cannot move in a supply-needle-insertion direction of the ink supply needle because it turns around. For this reason, there is a possibility that the supply valve is not opened and the ink cannot be supplied even though the ink supply needle is in contact with the supply valve.

Further, when the ball-shaped supply valve is mounted on the ink cartridge, a coil spring is inserted into the ink supply section and then the ball-shaped supply valve is inserted into the ink supply section into which the coil spring has been inserted. Next, the supply valve is temporarily stopped by a fixture in a state where the ball-shaped supply valve urged by the coil spring is pushed inwardly, and then a seal member is fitted into an ink supplying opening. After that, the fixture is removed from the ink cartridge. Consequently, the supply valve closes the ink supplying opening by an urging force of the coil spring. The method for assembling the ink supply section above is difficult and also takes time to assemble because of using the fixture. Therefore, there is a problem that the production cost of the ink cartridge becomes increased.

In addition, when the fixture is inserted into the ink supply section in order to fill ink during a process of filling ink, it is impossible to attach a film or the like for preventing the seal member from being fallen off, so that there is a problem that the seal member is fallen off or tilted by the urging force from when the seal member is fitted to when the film for preventing falling off is attached.

SUMMARY OF THE INVENTION

Therefore, it is an object of the present invention to provide a method for manufacturing a liquid cartridge and a liquid cartridge, which are capable of overcoming the above drawbacks accompanying the conventional art. The above and other objects can be achieved by combinations described in the independent claims. The dependent claims define further advantageous and exemplary combinations of the present invention.

According to the first aspect of the present invention, a method for manufacturing a liquid cartridge comprising a liquid accommodating chamber for containing therein a liquid, a hollow part having a liquid supplying opening, into which a liquid supplying needle of a liquid ejecting apparatus is inserted, while the liquid supplying opening communicates with the liquid accommodating chamber, a seal member contained in the hollow part, the seal member having an insertion opening being in elastic contact with an external circumference of the liquid supplying needle, while the liquid supplying needle is inserted into the insertion opening, a supply valve contained in the hollow part, the supply valve arranged in order to close or open the insertion opening of the seal member and an urging member for urging the supply valve toward the seal member, the method comprises an urging member insertion step of inserting the urging member into the hollow part from the liquid supplying opening, a seal member mounting step of mounting the seal member in the liquid supplying opening and a supply valve insertion step of inserting said supply valve into said hollow part from said insertion opening of said seal member mounted in said liquid supplying opening inserted during said seal member mounting step, and forming a state where said supply valve is pressed by an urging force of said urging member.

Due to this, it is possible to assemble the supply valve, the urging member and the seal member to the liquid supplying part easily without using the fixture to stop the supply valve temporarily.

In the method for manufacturing a liquid cartridge, the urging member insertion step may comprise a step of inserting a coil spring as the urging member into the hollow part from the liquid supplying opening, and the supply valve insertion step may insert the supply valve into the hollow part against an urging force of the coil spring by engaging the supply valve with the coil spring.

Due to this, it is possible to engage the coil spring and the supply valve securely, even after the supply valve is fitted into the hollow part of the liquid supplying part.

In the method for manufacturing a liquid cartridge, during the seal member mounting step, the seal member may be mounted in the liquid supplying opening of the liquid supplying part where the urging member is inserted in the urging member insertion step.

Due to this, it is possible to mount the urging member and the seal member on the liquid supplying part further easily, because the urging member is inserted before the seal member is mounted on the liquid supplying part.

According to the second aspect of the present invention, a liquid cartridge comprises a liquid accommodating chamber for containing a liquid, a hollow part having a liquid supplying opening, into which a liquid supplying needle of a liquid ejecting apparatus is inserted, while the liquid supplying opening communicating with the liquid accommodating chamber, a seal member contained in the hollow part, the seal member having an insertion opening being in elastic contact with an external circumference of the liquid supplying needle, while the liquid supplying needle is inserted to the insertion opening, a supply valve contained in the hollow part, the supply valve arranged in order to close or open the insertion opening of the seal member and an urging member for urging the supply valve toward the seal member, wherein the supply valve comprises a body part having a circular cross-section, of which a diameter is substantially the same as a diameter of the hollow part of the liquid supplying part, and having a cylindrical shape, of which a height is higher than the diameter of the hollow part of the liquid supplying part, a taper part formed at a first end of the body part, the taper part having an end engaged with the urging member and a bottom face formed at a second end of the body part, the bottom face having a flat surface being in contact with the seal member.

Due to this, since the height of the body part of the supply valve is larger than the diameter of the hollow part of the liquid supplying part, the supply valve does not turn on the surface parallel to the sliding direction of the supply valve at the time of assembly and when the liquid supplying needle is in contact with the supply valve, and it can slide along the hollow part of the liquid supplying part securely. In addition, since the supply valve has the taper part, it is possible to insert the supply valve into the liquid supplying part from the insertion opening of the seal member even after the seal member is fitted into the liquid supplying part. Further, since the supply valve has the flat bottom face, it can move in the sliding direction securely when the liquid supplying needle is in contact with the supply valve.

In the liquid cartridge, the urging member may be a coil spring, and a distance between the taper part engaged with the first end of the coil spring in the hollow part of the liquid supplying part and a spring seat for preventing the second end of the coil spring from moving in the hollow part may be longer than the height of the body part of the supply valve, when the bottom face of the supply valve is in contact with the seal member.

Due to this, since the space where the coil spring is provided is long enough, it is possible to use a coil spring of which the wire diameter is large and the urging force is strong. Therefore, it is possible to urge the supply valve to the seal member by the coil spring with a strong force.

A diameter of the body part of the supply valve may be larger than a diameter of the liquid supplying needle inserted from the liquid supplying opening to allow the supply valve to slide in the hollow part.

Due to this, since the diameter of the seal member is smaller than the diameter of the liquid supplying part, the supply valve having the body part of which the diameter is larger than the liquid supply needle can seal the insertion opening of the seal member securely.

The supply valve may have a concave part for accepting the coil spring to urge the supply valve.

Due to this, since the coil spring is provided to the concave part of the supply valve, the urging force of the coil spring is transferred to the supply valve securely. Therefore, the supply valve can seal the insertion opening of the seal member securely. Further, since the concave part is provided in the supply valve for the liquid cartridge, it is possible to prevent the sink at the bottom face of the supply valve when the supply valve for the liquid cartridge is formed by injection molding.

The summary of the invention does not necessarily describe all necessary features of the present invention. The present invention may also be a sub-combination of the features described above. The above and other features and advantages of the present invention will become more apparent from the following description of the embodiments taken in conjunction with the accompanying drawings.

DETAILED DESCRIPTION OF THE INVENTION

The invention will now be described based on the preferred embodiments, which do not intend to limit the scope of the present invention, but exemplify the invention. All of the features and the combinations thereof described in the embodiment are not necessarily essential to the invention.

Figure 1:
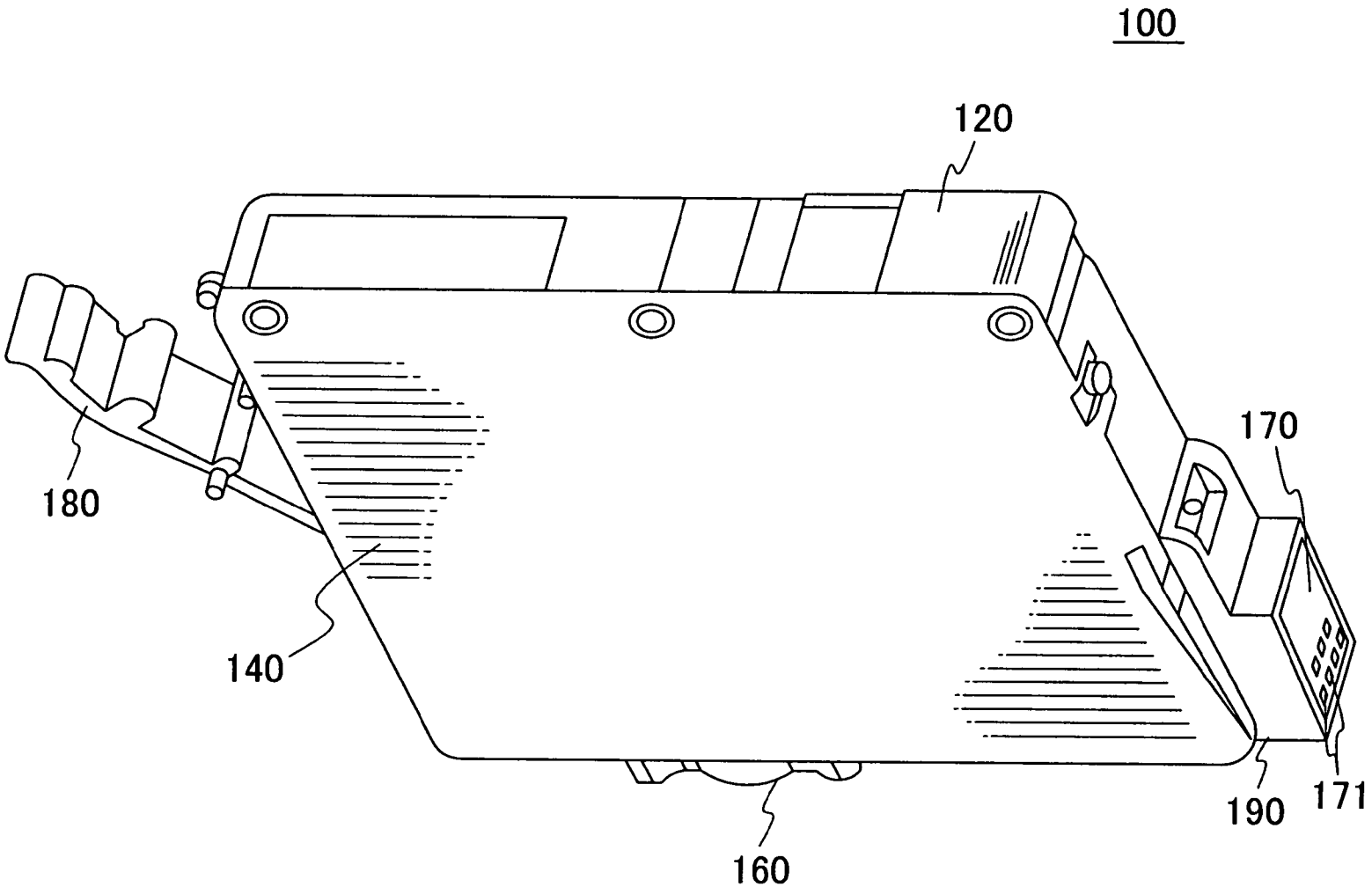
FIG. 1 is a front perspective view of an ink cartridge 100 according to a first embodiment.

FIG. 1 is a front perspective view of the structure of the ink cartridge 100 used for an inkjet type recording apparatus, which is adapted for an example of a liquid cartridge suitable for supplying a liquid to a liquid ejecting head of a liquid ejecting apparatus, obliquely viewed from an upper position.

In addition, the liquid ejecting apparatus of the present invention is not limited to the liquid ejecting head of the liquid ejecting apparatus, and it includes a color material ejecting head of the color filter manufacturing apparatus for manufacturing color filters of a liquid crystal display, an electrode material (conduction paste) ejecting head for forming electrodes such as an organic EL display or a FED (Field Emission Display) and further a bio organism ejecting head of the biochip manufacturing apparatus and a sample ejecting head as a minute pipette for manufacturing biochips.

Figure 2:
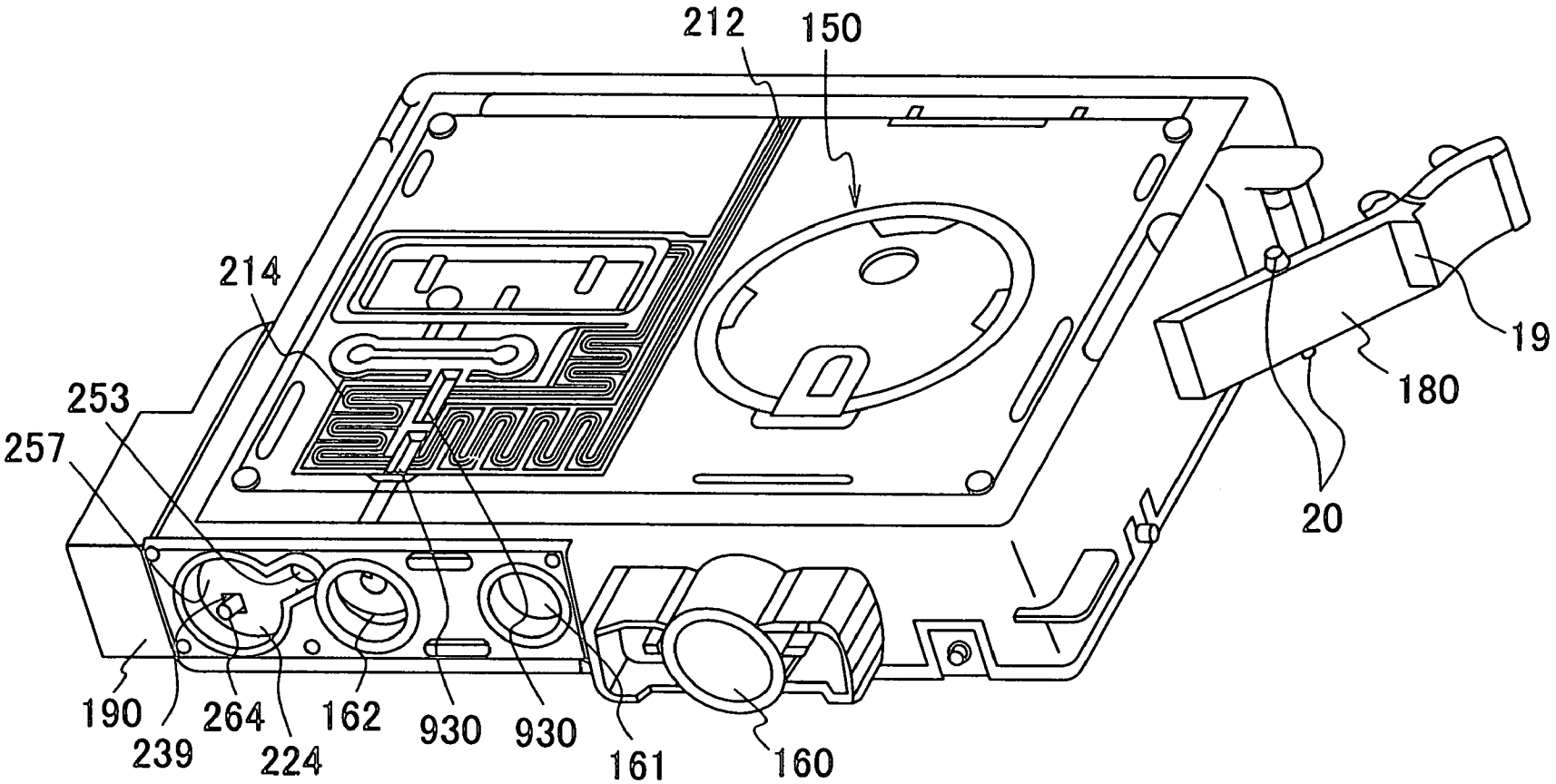
FIG. 2 is a rear perspective view of an ink cartridge 100 before a film 110 is attached.
Figure 3:
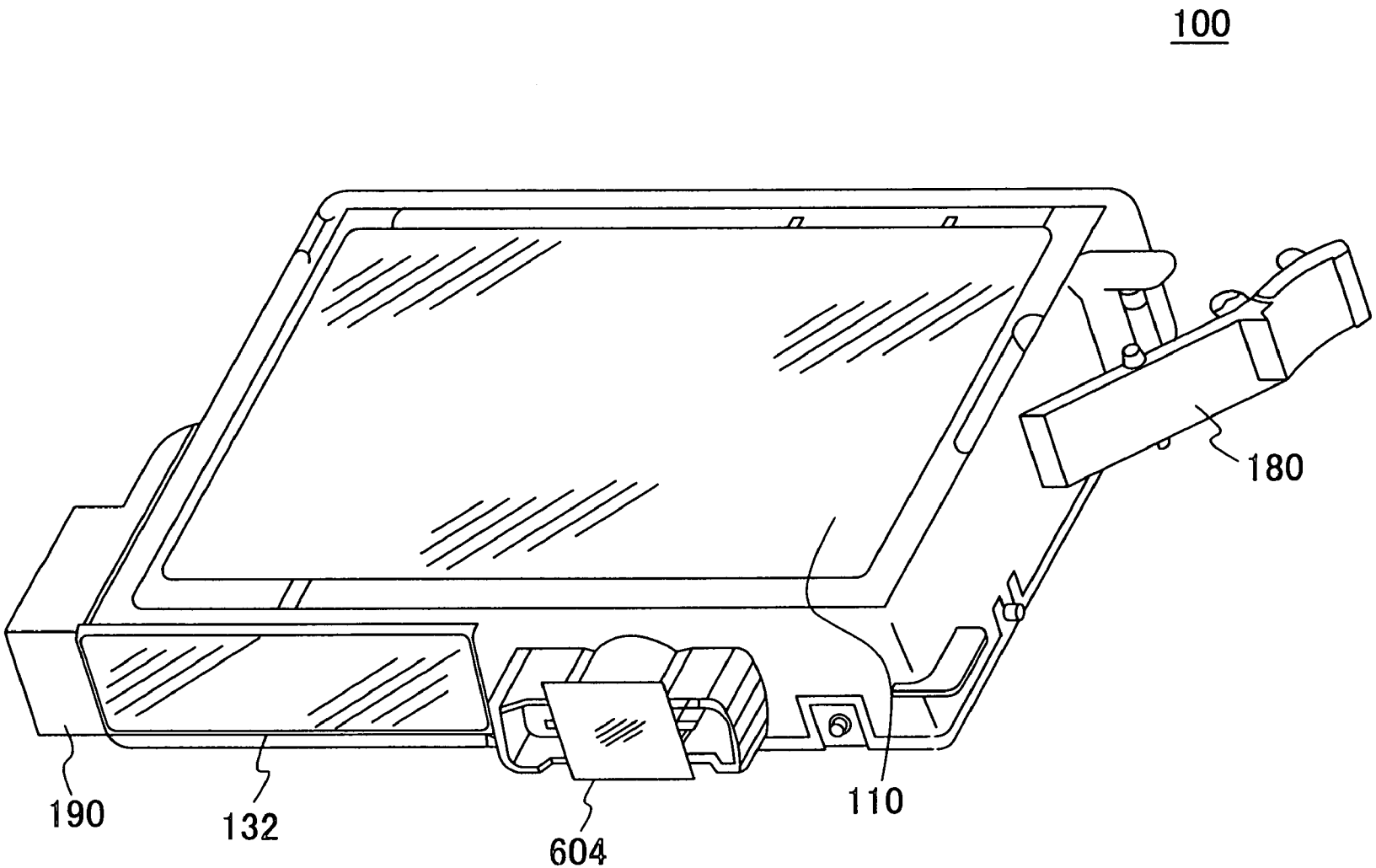
FIG. 3 is a rear perspective view of an ink cartridge 100 after a film 110 is attached.
Figure 4:
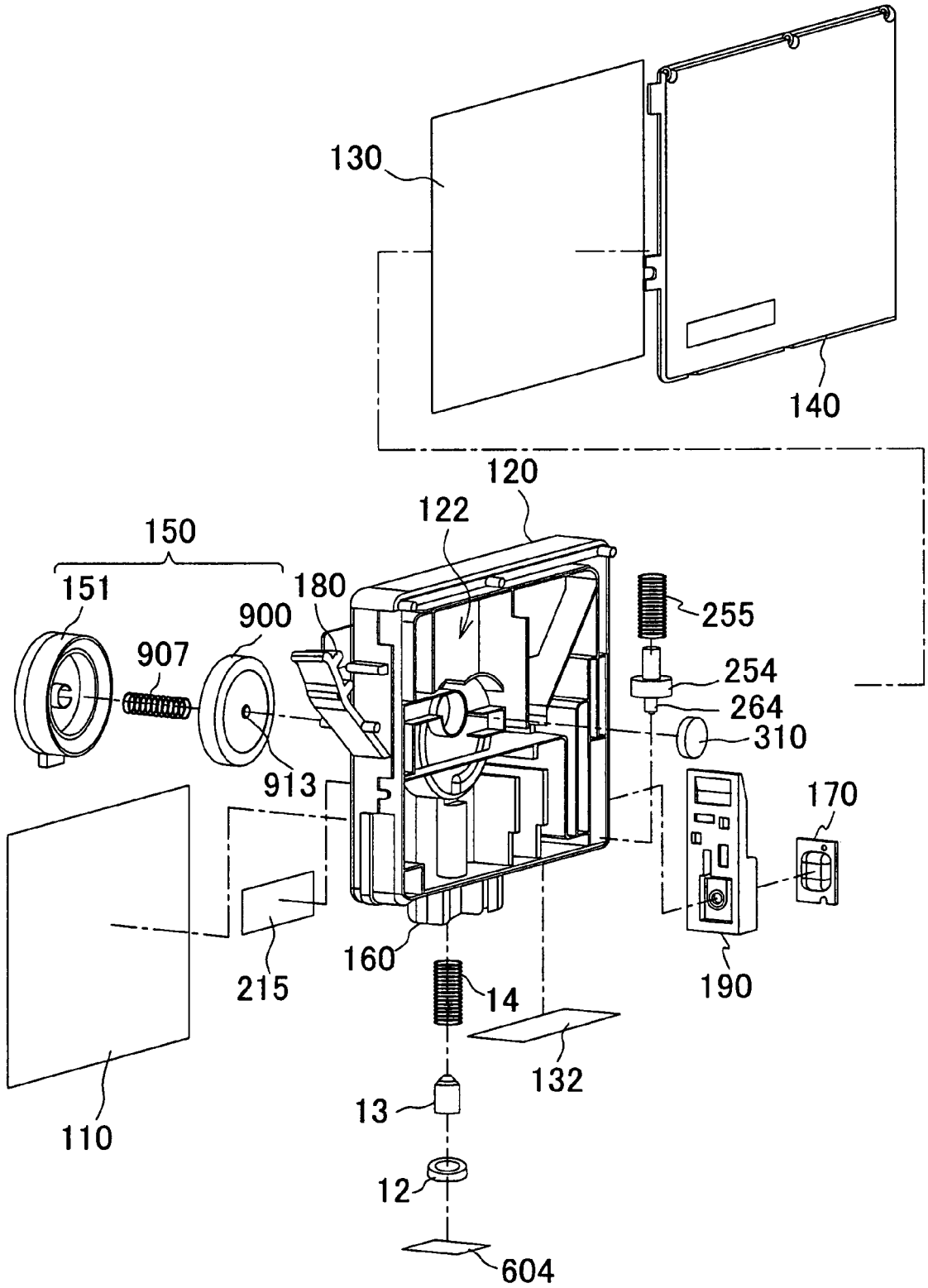
FIG. 4 is an exploded perspective view of an ink cartridge 100.
Figure 5:
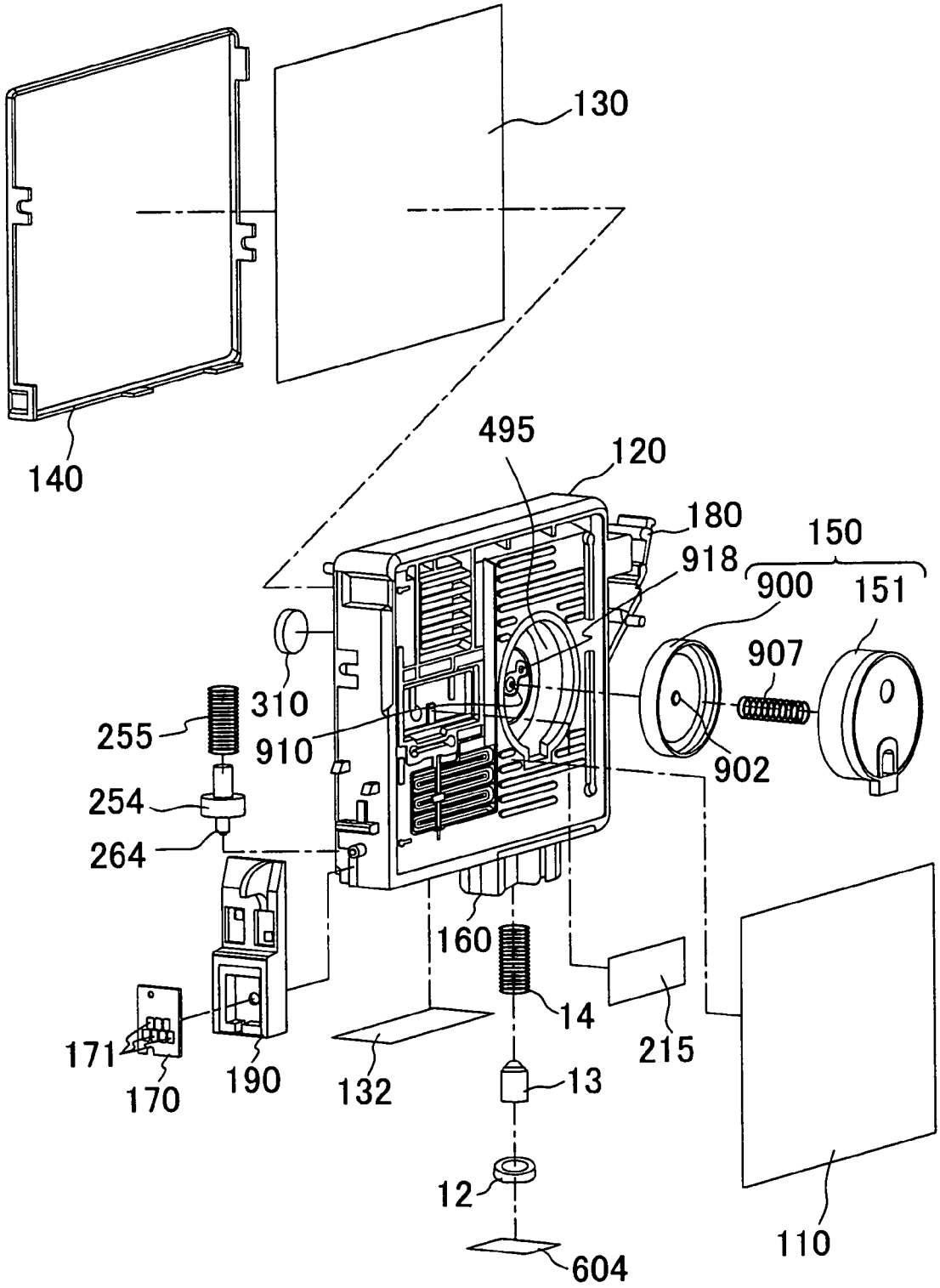
FIG. 5 is an exploded perspective view of an ink cartridge 100.
Figure 6:
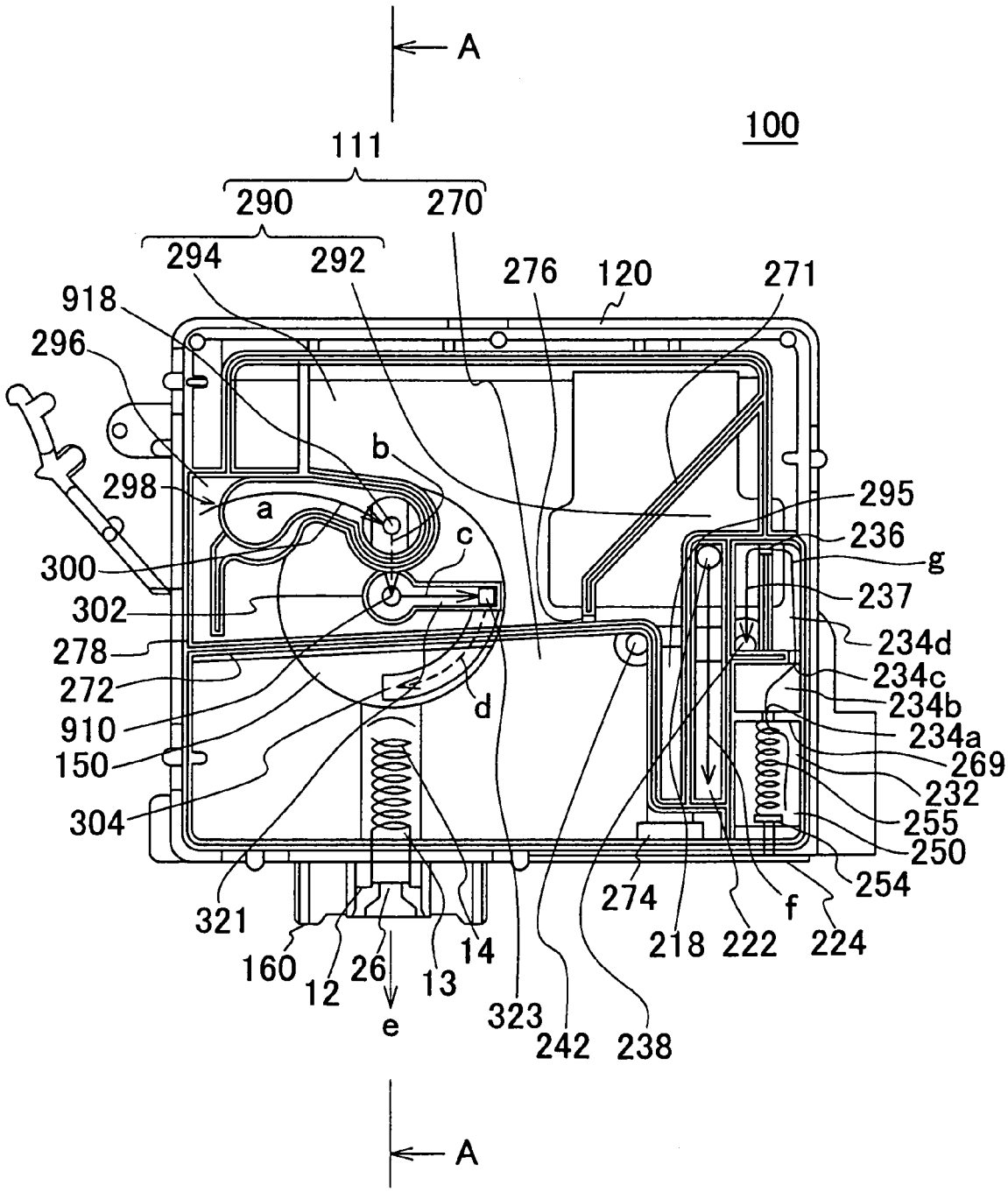
FIG. 6 is a front view of an ink cartridge 100 in a state before a film 130 is attached.
Figure 7:
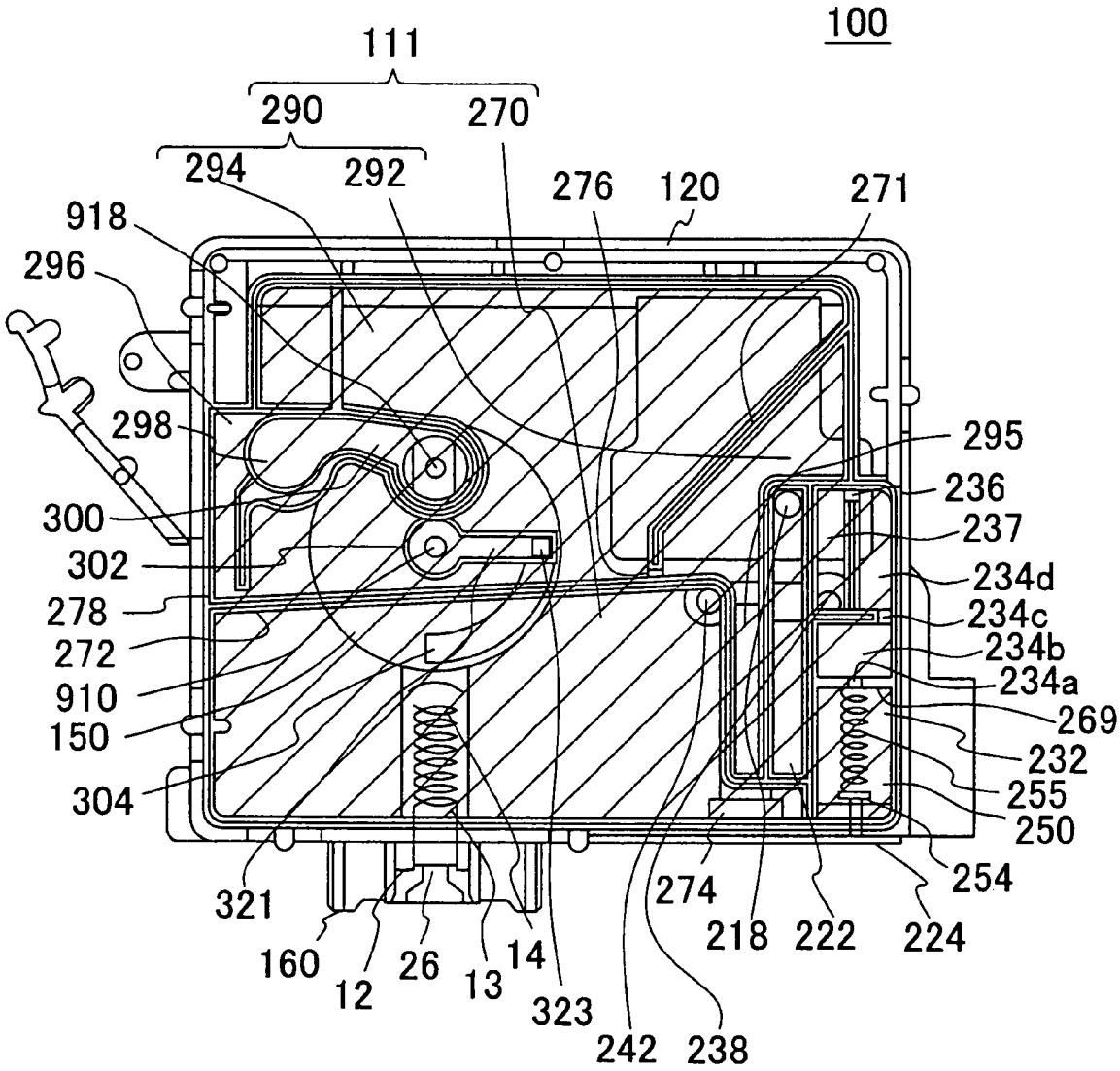
FIG. 7 is a front view of an ink cartridge 100 in a state after a film 130 is attached.

FIG. 2 and FIG. 3 are rear perspective views the ink cartridge 100 in FIG. 1 obliquely viewed from a lower position, FIG. 2 shows the ink cartridge 100 in a state a film 110 is not attached thereto and FIG. 3 shows the ink cartridge 100 in a state the film 110 is attached thereto. Further, FIG. 4 and FIG. 5 are perspective views showing the ink cartridge 100 wherein members of which the ink cartridge 100 consist is exploded. FIG. 6 and FIG. 7 are front views of the ink cartridge 100 in FIG. 1, FIG. 6 shows the ink cartridge 100 in a state before a film 130 is attached to an opening part 122 of the ink cartridge 100 and FIG. 7 shows the ink cartridge 100 in a state in which a film 130 is attached to an opening part 122 of the ink cartridge 100. In addition, the film 130 is attached to an area, which is shown with hatching in FIG. 7.

As shown in FIG. 4, the ink cartridge 100 has a cartridge body 120 having a shape of an approximate case with the opening part 122, the film 130, which covers almost all face of the opening part 122 and a lid 140, which covers the outside of the film 130. The internal part of the cartridge body 120 is partitioned by ribs or walls as described below. The film 130 seals almost all face of the opening part 122 of the cartridge body 120 in order that the internal part of it comes into a closed state. The lid 140 is further fixed to the cartridge body 120 in order to wrap the outside of the film 130 in a non-closed state.

The cartridge body 120 has an ink accommodating chamber 111 for containing ink, an ink channel part from the ink accommodating chamber 111 to an ink supply section 160, an ink side passage, which allows the ink accommodating chamber 111 to communicate with the atmosphere, the atmospheric valve accommodating section and an atmosphere communicating part, which consists of an atmosphere passage, and it is made of, for example, Polypropylene (PP) in a unified body.

The ink cartridge 100 further has an ink supply controlling means 150, a memory 170 and an engaging lever 180. The ink supply section 160 supplies ink, which is contained in the ink accommodating chamber 111, to the recording head of the inkjet type recording apparatus through an ink supply needle of the apparatus which needle is inserted into an opening of the ink supplying section 160. The ink supply needle faces the lower face of the cartridge body 120 and is formed on the carriage 42 mounting thereon the ink cartridge 100. The memory 170 is caulked into an attaching part 190 and the attaching part is caulked and attached to the lower part of the side face of the cartridge body 120. The memory 170 stores the information on the kind of the ink cartridge 100, the information on the color held by the ink cartridge 100 and the information on the present amount of remaining ink etc., and it transfers this information by a plurality of terminals 171, which are exposed thereon, between the apparatus body and the ink cartridge 100. The engaging lever 180 is formed at the upper part of the side face opposite to the attaching part 190 in regard to the cartridge body 120, and is engaged with the carriage of the inkjet type recording apparatus.

An ink supply controlling means 150 consists of a differential pressure valve, which supplies ink of the ink accommodating chamber 111 to the ink supply section 160 by pressure difference between ink accommodating chamber 111 and the ink supply section 160 that occurs accompanying the consummation of ink. The ink supply controlling means has a membrane valve 900, which is an example of a valve member inserted into a concave part 495 of the cartridge body 120, capable of elastic deformation, a valve lid 151 which covers the concave part 495, a coil spring 907 which is an example of an urging member arranged between the membrane valve 900 and the valve lid 151.

The ink accommodating chamber 111 is divided by a wall 272 mainly into a upper part and a lower part, which extends in a horizontal direction, as shown in FIG. 6 and FIG. 7, and an atmospheric side accommodating chamber 270, which can communicate with the ambient air by a communicating hole 242, is formed in the lower part, while a liquid-supply side accommodating chamber, which consists of a first ink accommodating chamber 292 and a second ink accommodating chamber 294 and is blocked from the atmosphere, is formed in the upper part. The liquid-supply side accommodating chamber 290 is divided by a slope wall 271 having a communicating part 276 near the wall 272 (at the lower part area) into the first and second ink accommodating chambers 292 and 294, and is provided with a channel part 296, which is arranged in order to surround the circumference of the second ink accommodating chamber 294. The channel part 296 is coupled with the second ink accommodating chamber 294 via a communicating part 278 at the lower part, and besides is coupled with the ink supply controlling means 150 via passages 298 and 300 and a passage hole 918.

Moreover, the lower flow side of the ink supply controlling means 150 is configured to communicate with the ink supply section 160 via a passage hole 910 which communicates with the ink supply controlling means 150, a communicating part 302 and a channel 321 which communicate with the passage hole 910, a passage hole 323 which is formed at an end of the channel 321 and is formed to face the front face side and a communicating part 304 of which an end communicates with the passage hole 323.

The atmospheric side accommodating chamber 270 and the first ink accommodating chamber 292 communicate with each other by a communicating passage 295 which extends vertically, and are configured in order that the ink in the atmospheric side accommodating chamber 270 is sucked up into the first ink accommodating chamber 292 corresponding to the consummation of ink from the ink supply section 160 and then is flowed into the ink supply controlling means 150 via the second ink accommodating chamber 294 and the channel part 296 etc. The ink is flowed into the ink supply controlling means 150 from the atmospheric side accommodating chamber 270 of the ink accommodating chamber 111 through a sequence of the communicating part 274, a second ink injection hole 162, a communicating passage 295, the communicating parts 276 and 278, the channel part 296, the passages 298 and 300 and the passage hole 918.

Meanwhile, the atmospheric valve part 250 has an atmospheric valve accommodating section 232, which is hollow therein, for containing an atmospheric valve 254, and has a communicating hole 239, also serving as a atmosphere communicating channel, of which the diameter is a little larger than that of a shaft part 264 of the atmospheric valve 254, on the wall face of a lower position of the atmospheric valve accommodating section 232, so that the shaft part 264 of the atmospheric valve 254 is always urged towards the bottom face of the ink cartridge 100 by a spring 255 and inserted thereto to be able to freely slide, and the communicating hole 239 is sealed by the atmospheric valve 254 when the ink cartridge 100 is not mounted onto the carriage of the inkjet type recording apparatus. Owing to this, the atmospheric valve 254 is arranged to be capable of moving in a vertical direction in which the ink cartridge 100 is mounted on the carriage, and opens the communicating hole 239 by being pressed upward by a contact member 60 as an example of a contact member formed in carriage when mounted on the carriage.

Figure 8:
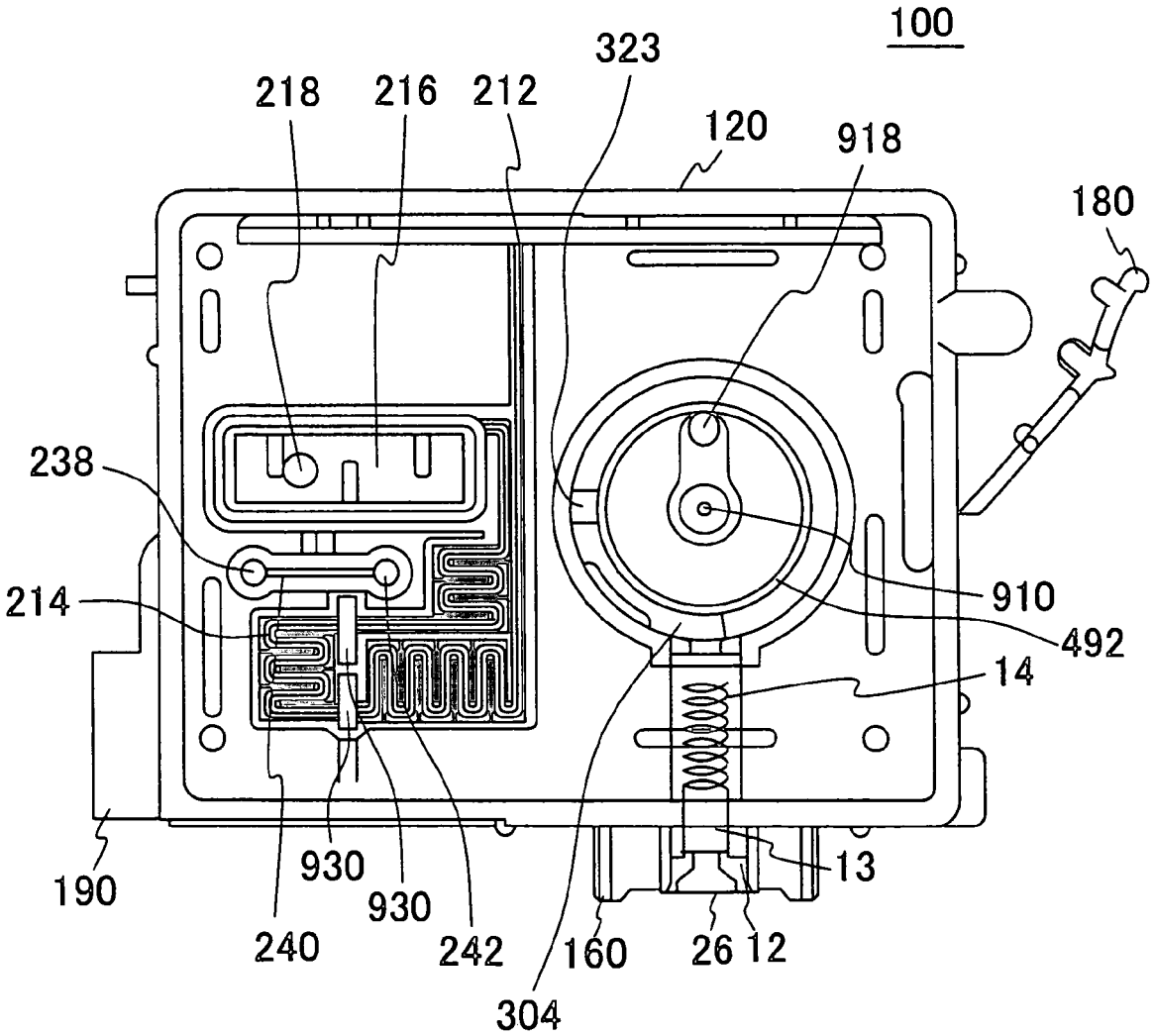
FIG. 8 is a rear view of an ink cartridge 100 in a state before a film 110 is attached.

FIG. 8 is a rear view showing the ink cartridge 100 of FIG. 1 in a state before the film 110 is attached thereto. The atmosphere side passage, which communicates with the atmosphere taking the communicating hole 239 described above as a boundary, consists of an opening 212, a passage 214 which is circuitous or winding, a filter accommodating section 216, a communicating hole 218, a communicating part 222 and a communicating hole 253 and a communicating part 224 which are formed on the bottom face of the communicating part 222.

Particularly, as shown in FIG. 8, an end of one circuitous passage 214, which is formed on the front face of the cartridge body 120 and winding in the shape of a maze, is opened with the atmosphere by the opening 212, and the other end is coupled with the filter accommodating section 216 for containing the filter 215 (FIG. 4 and FIG. 5) having a function of ink repellency and air permeability. The filter container part 216 communicates with the communicating hole 218, which penetrates from the front side to the rear side of the cartridge body 120. The communicating hole 218 is coupled with the communicating part 224 via the communicating part 222 and the communicating hole 253, which is formed on the bottom part of a room that partitions the communicating part 222, in the rear side of the cartridge body 120. In the middle of the passage 214, a chamber 930, which consists of a concave part, is provided.

As shown in FIG. 2, the communicating part 224 is formed as a concave part 257 on the bottom face of the cartridge body 120, and a shaft part 264, which is an operating rod of the atmospheric valve 254, is exposed, while the communicating hole 239 capable of communicating with the atmospheric valve accommodating section 232, which contains the atmospheric valve 254, and the communicating hole 253, which communicates with the communicating part 222, are formed inside the concave part 257, and the external face of the concave part 257 is sealed by the film 132 for sealing the first and second ink injection holes 161 and 162. A material, which can perform elastic deformation by a pressing force of a projection protruding from the carriage, is chosen for this film 132.

Meanwhile, as shown in FIG. 6, the ink side passage, which communicates with the atmospheric side accommodating chamber 270 taking the communicating hole 239 described above as a boundary, consists of an atmospheric valve accommodating section 232, a passage hole 234*a*, a communicating chamber 234*b*, a communicating part 234*c*, a communicating chamber 234*d*, a communicating part 236, a communicating chamber 237 and a communicating hole 238, a communicating groove 240 and a communicating hole 242. Particularly, the passage hole 234*a* is formed on a wall of upper part of the atmospheric valve accommodating section 232, and the atmosphere passage is formed to communicate in the following sequence: the communicating chamber 234*b* via the passage hole 234*a*, the communicating part 234*c* formed by a notch on a wall of the upper part of the communicating chamber 234*b*, the communicating chamber 234*d* provided at the upper part of the communicating part 234*c*, the communicating part 236 formed by a notch of a wall of the upper part of the communicating chamber 234*d* and the communicating chamber 237 provided with the communicating hole 238 at a lower position.

The communicating hole 238, which penetrates from the rear side to front side of the cartridge body 120, communicates with the atmospheric side accommodating chamber 270 via the communicating groove 240, which communicates with the communicating hole 238, and the communicating hole 242, which communicates with the communicating groove 240 and also penetrates from the front side to the rear side of the cartridge body 120.

These the atmospheric side accommodating chamber 270, the liquid-supply side accommodating chamber 290, the atmospheric valve part 250 and the atmosphere side passage and the ink side passage become an area which is separated from the atmosphere by attaching the films 130 and 110 to the wall partitioning each of those by thermo welding or fuse bonding.

The ink supply section 160 has a seal member 12, which is made of elastomer having an insertion opening 26 into which the ink supply needle provided in the carriage is inserted, a supply valve 13, which closes the insertion opening 26 of the seal member 12 and an urging member, which consists of a coil spring etc. that urges the supply valve 13 towards the seal member 12. In addition, a film 604 is attached to the insertion opening 26 of the seal member 12 at the time of factory.

When the ink cartridge 100 is mounted on the carriage of the inkjet type recording apparatus, the projecting part provided in the carriage pushes up the shaft part 264 of the atmospheric valve upwardly via the film 132 and the ink supply needle of the carriage pushes up the supply valve 13 of the ink supply section 160 upwardly. Due to this, the communicating hole 239 allows the atmosphere channel, extending the atmospheric valve accommodating section 232 to the communicating hole 242, to communicate with the atmosphere. And, the upper flow than the supply valve 13 in regard to the ink supply section 160 communicates with the ink supply needle.

When the inkjet type recording apparatus begins to record in a state where the communicating hole 242 communicates with the ambient air, the recording head is supplied with ink through the ink supply needle from the ink supply section 160. When ink is supplied from the ink supply section 160, the ink, which is flowed in a sequence of an arrow a shown in FIG. 6 and the passage hole 918 in the ink accommodating chamber 111, is flowed in a sequence of arrows b, c and d shown in FIG. 6 via the ink supply controlling means 150, is flowed into the ink supply section 160 and is supplied to the ink supply needle inserted in the ink supply section 160.

According to this flow of ink, in the ink accommodating chamber 111, the ink of the atmospheric side accommodating chamber 270 is supplied to the liquid-supply side accommodating chamber 290. The atmosphere accompanying the consummation of ink in the atmospheric side accommodating chamber 270 is flowed into the atmospheric side accommodating chamber 270 from the communicating hole 242 through a route in a sequence of an arrow f in FIG. 6, the communicating part 224 of the bottom face and an arrow g. Although the liquid level of the atmospheric side accommodating chamber 270 goes down because ink is provided to the recording head from the ink supply section 160, the channel, which is coupled with the atmospheric side accommodating chamber 270 and the liquid-supply side accommodating chamber 290, is provided with a communicating opening at the lowest part of the atmospheric side accommodating chamber 270, so that the atmosphere is not flowed into the liquid-supply side accommodating chamber 290 until all of the ink in the atmospheric side accommodating chamber 270 is moved to the liquid-supply side accommodating chamber.

After the ink in the atmospheric side accommodating chamber 270 is completely consumed, the ink in the first and second ink accommodating chambers 292 and 294 of the liquid-supply side accommodating chamber 290 is consumed in that sequence. During that time, due to the surface tension caused by the meniscus of ink formed in the second ink injection hole 162, which communicates with the liquid-supply side accommodating chamber 290 and the atmospheric side accommodating chamber 270, the ink in the liquid-supply side accommodating chamber 290 is prevented from being flowed backward to the atmospheric side accommodating chamber 270.

When the ink in the first ink accommodating chamber 292 begins to be consumed, the air is flowed into the first ink accommodating chamber 292. Due to this, the liquid level of the first ink accommodating chamber 292 goes down, but the first and second ink accommodating chambers 292 and 294 communicate by the communicating part 276 only at the lower part, so that the ink in the first ink accommodating chamber 292 is first consumed. When the liquid level reaches the communicating part 276 because the ink in the first ink accommodating chamber 292 is consumed, the air is flowed into the second ink accommodating chamber 294 according to the consummation of ink in the second ink accommodating chamber 294. While the ink in the second ink accommodating chamber is consumed, the surface tension caused by the meniscus of ink in the communicating part 276 occurs, and therefore the ink in the second ink accommodating chamber 294 is prevented from being flowed backward to the first ink accommodating chamber 292.

As described above, although the ink in the atmospheric side accommodating chamber 270 and the first and second ink accommodating chambers 292 and 294 is consumed in that sequence, the ink is supplied into the ink supply section 160 through the passage hole 918 via the passage 300 from the communicating part 278, which is provided near the wall 272 that partitions the ink accommodating chamber into nearly two parts up and down, even though the liquid level of ink exists in any accommodating section.

Figure 9:
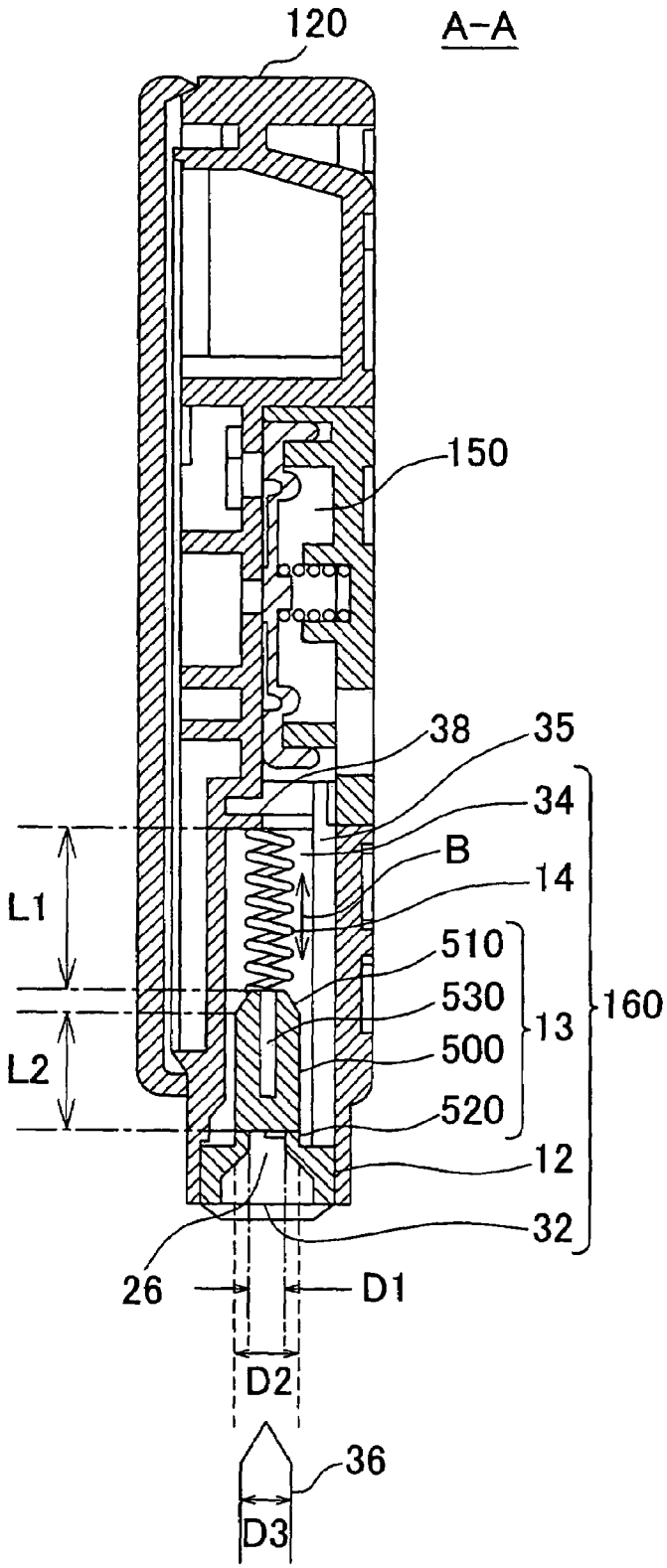
FIG. 9 is a cross-section view of an ink cartridge 100.

FIG. 9 is a cross-section view that shows an A—A section in regard to the ink cartridge 100 in FIG. 6. The ink supply section 160 is provided with a hollow part 34 having an ink supplying hole 32 at a bottom face. The ink supplying hole 32 is formed at a lower face side of the ink cartridge 100, and the ink supply needle 36 of the inkjet type recording apparatus is inserted. The hollow part 34 is a hollow cylinder in shape, and has a passage 35 in the shape of a groove provided on the external side of the cylinder along the longitudinal direction of the cylinder. In the hollow part 34 of the ink supply section 160, an the urging member 14, a supply valve 13 and a seal member 12 are provided to face from the ink supply controlling means 150 to the ink supplying hole 32 in that sequence. In the embodiment shown in FIG. 9, the urging member 14 is a coil spring. The seal member 12 is made of an elastic material such as elastomer. An insertion opening 26 elastically arranged at an external circumference of the ink supply needle 36 is provided in the seal member 12, while the ink supply needle 36 is inserted. One end of the urging member 14 is in contact with a spring seat 38 in the hollow part 34, and the other end is engaged with the supply valve 13 to urge the supply valve 13 toward the seal member 12. The spring seat 38 controls the urging member 14 in the hollow part 34 so that the position of an end of the urging member 14 is not moved.

When the ink supply needle 36 is inserted into the insertion opening 26 of the seal member 12 and pushes up the supply valve 13, the supply valve 13 slides upwardly along a sliding direction B in the hollow part 34 and is separated from the insertion opening 26 of the seal member 12. Consequently, it is possible to position a passage hole of the ink supply needle 36 not shown to the hollow part 34 side rather than a position where the seal member 12 and the supply valve 13 are in contact with each other, and thus the hollow part 34 and the passage hole of the ink supply needle 36 communicate with each other so that the recording head communicating with the ink supply needle 36 can be ready to be supplied with ink.

Meanwhile, when the ink supply needle 36 is pulled out from the insertion opening 26 of the seal member 12, the supply valve 13 slides downwardly along the sliding direction in the hollow part 34 by the elastic force of the urging member 14, and seals the insertion opening 26 of the seal member 12.

The supply valve 13 has a body part 500, a taper part 510, a bottom face 520 and concave part 530, and is formed by injection molding of, e.g., Polypropylene. The supply valve 13 is contained in the hollow part 34, and is placed so as to open the insertion opening 26 of the seal member 12. The body part 500 of the supply valve 13 is a nearly cylinder in shape, and the outer diameter of the body part 500 is substantially the same as the diameter of the hollow part 34. In addition, the height of the body part 500 in the sliding direction is larger than the diameter of the hollow part 34. Therefore, when the ink supply needle 36 is in contact with the supply valve 13, the supply valve 13 does not deviate from the sliding direction of the supply valve 13, and can slides along the sliding direction B smoothly. In addition, a part of the body part 500 in the shape of a cylinder is flat, but this is a position of a gate in case the supply valve 13 is formed by injection molding. The taper part 510 is tapered at an upper end of the body part 500 in the state of being contained in the hollow part 34. The bottom face 520 is formed at a lower end of the body part 500 in the state of being contained in the hollow part 34, and all the face is a flat surface. Due to this, the ink supply needle 36 is pressed to the flat surface of the bottom face 520 of the supply valve 13, so that the supply valve 13 can be moved along the sliding direction B securely. In the supply valve 13, a concave part 530 is provided from the taper part 510 to an intermediate level inside the body part 500 toward the bottom face 520. Due to this, it is possible to prevent the sink from occurring when forming the supply valve 13 by injection molding and to form the bottom face 520 in the shape of a flat surface.

As shown in FIG. 9, the distance L1 from the spring seat 38 to the end of the supply valve 13 in the state where the ink supply needle 36 is not inserted into the insertion opening 26 of the seal member 12 is longer than the length L2 of the body part 500 in the sliding direction B. Therefore, it is possible to use the coil spring of which the urging force is strong by making the wire diameter of the urging member 14 big. Since the supply valve 13 is pressed by a strong force of the coil spring to the insertion opening 26 of the seal member 12, it is possible to seal the insertion opening 26 of the seal member 12 securely.

As shown in FIG. 9, an inner diameter D1 of the insertion opening 26 of the seal member 12 is smaller than an outer diameter D2 of the body part 500 of the supply valve 13 and an outer diameter D3 of the ink supply needle 36. Since the inner diameter D1 of the insertion opening 26 of the seal member 12 is smaller than the outer diameter D3 of the ink supply needle 36, the seal member 12 seals between the ink supply needle 36 and the insertion opening 26 securely by elastic deformation when the ink supply needle 36 is inserted into the insertion opening 26. In addition, the outer diameter D2 of the body part 500 of the supply valve 13 is larger than the outer diameter D3 of the ink supply needle 36. Therefore, even when the ink supply needle 36 is pulled out from the insertion opening 26 of the seal member 12, the supply valve 13 is not fallen off from the ink supply needle 36 and the insertion opening, and it is possible to seal the insertion opening 26 securely. Further, since the supply valve 13 can be configured to have a small size and a simple shape, it is possible to shorten the distance between the ink supply controlling means 150 and the supply valve 13 in contrast to the prior art. Therefore, it is possible to increase the capacity of ink in comparison to the conventional ink cartridge.

Figure 10:
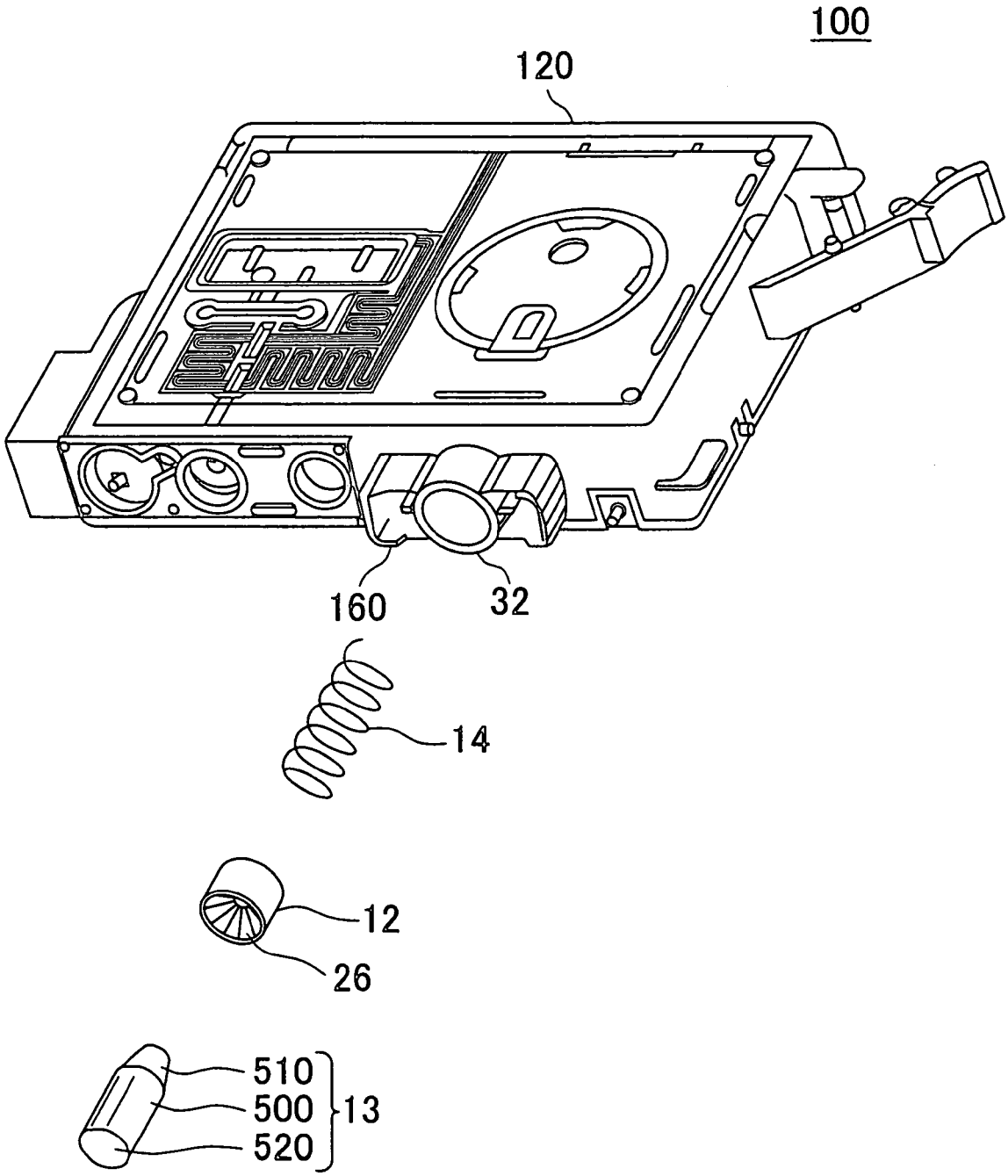
FIG. 10 is an exploded perspective view of an ink supply section 160.

FIG. 10 is an exploded perspective view of the ink supply section 160. In assembling the ink supply section 160, the urging member 14 is first inserted into the hollow part 34 from the ink supplying hole 32 of the ink supply section 160. Then, the seal member 12 is fitted into the ink supplying hole 32 of the ink supply section 160 in which the urging member 14 has been inserted. Moreover, it is preferable that the outer diameter of the coil spring of the urging member 14 is larger than the inner diameter D1 of the insertion opening 26 of the seal member 12. Due to this, it is possible to prevent the coil spring of the urging member 14 bouncing out from the insertion opening 26. Next, the supply valve 13 is pushed into the insertion opening 26 the seal member 12 fitted into the ink supplying hole 32, and is inserted into the hollow part 34 against the urging force of the urging member 14. Since the supply valve 13 has the taper part 510 at its end, it is inserted into the ink supply section 160 through the insertion opening 26 of which the diameter is smaller than the body part 500 even after the seal member 12 is fitted into the ink supplying hole 32. And, the end of the taper part 510 enters the inside of the coil spring of the urging member 14, and the supply valve 13 and the urging member 14 is engaged with each other securely. In addition, the urging member 14 may be inserted into the hollow part 34 from the insertion opening 26 of the seal member 12 after the seal member 12 is fitted into the ink supplying hole 32, or further the supply valve 13 may be inserted into the hollow part 34 from the insertion opening 26.

When the supply valve 13 is inserted into the hollow part 34, it is in contact with the seal member 12 by the urging force of the urging member 14. Since the supply valve 13 is inserted into the ink supplying hole 32 where the urging member 14 and the seal member 12 are already assembled, it is possible to perform the engagement of the supply valve 13 and the urging member 14 and the insertion of the supply valve 13 into the hollow part 34 at the same time. Therefore, it is possible to assemble the ink supply section 160 easily. Due to this, it is possible to reduce the man-hour of assembling the ink supply section 160 and to decrease the production cost of the ink cartridge 100.

Further, according to the present embodiment, unlike the conventional method of assembling the seal member in the state the urging part and the supply valve is fitted in advance, it is not necessary to insert the fixture from the side face of the cartridge and stop the supply valve temporarily against the urging force of the urging member. Therefore, it is unnecessary to provide a hole for inserting the fixture for stopping the supply valve temporarily in the ink cartridge 100. In addition, the cost of making the fixture is not needed, so that the production cost of the ink cartridge 100 is further reduced.

Figure 11:
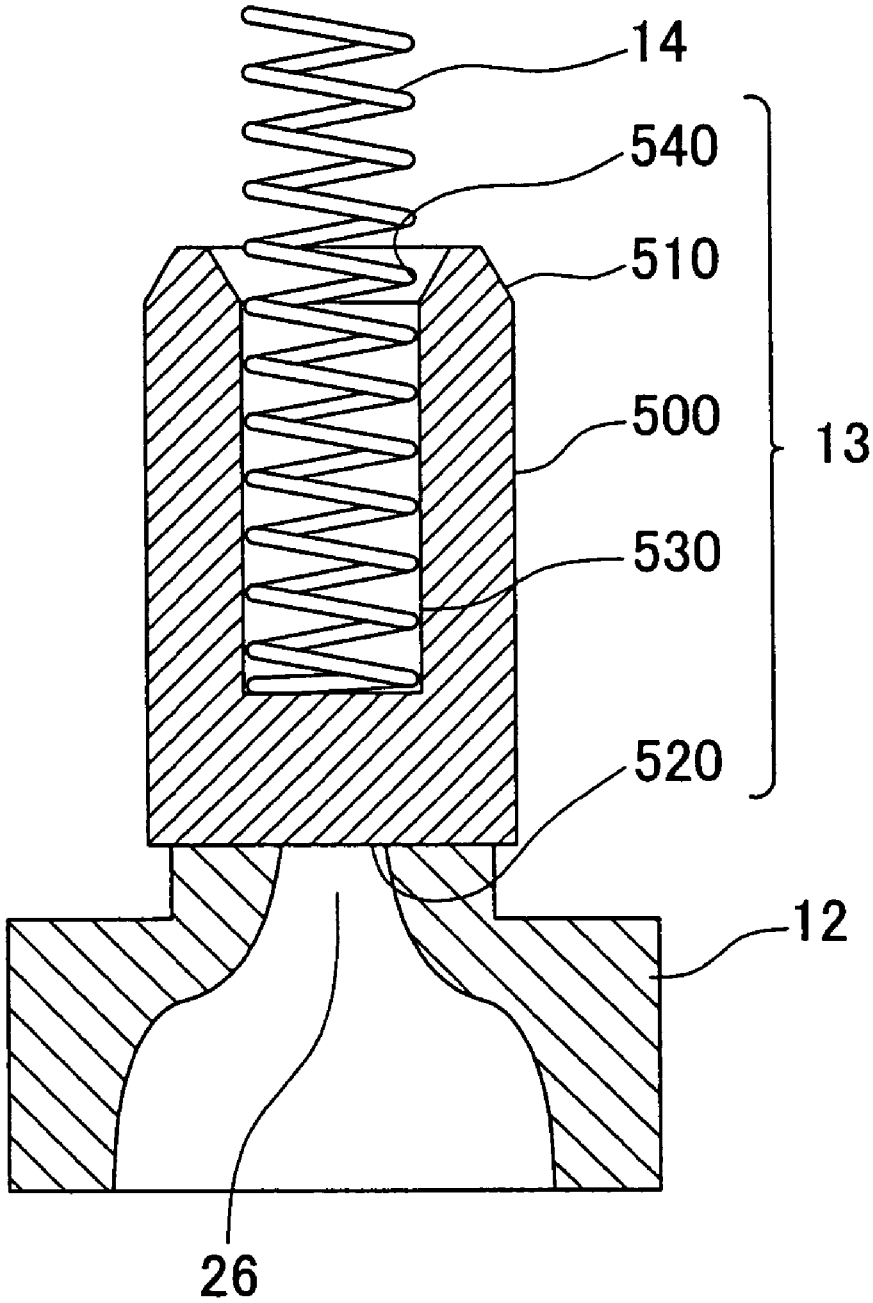
FIG. 11 shows another embodiment of a supply valve.

FIG. 11 shows another embodiment of the supply valve 13. A concave part 530 of a supply valve 13 is provided along the center axis of a body part 500 in the shape of a cylinder from an end part where a taper part 510 of the body part 500. An inner diameter of the concave part 530 is substantially the same as an outer diameter of a coil spring, an example of the urging member 14. One end of the urging member 14 is inserted into the concave part 530. Further, at an end part of the concave part 530, an internal-side taper part is provided to have an inclined cross-section so that the inner diameter becomes small gradually from the end of the concave part 530 inwardly.

Since one end of the urging member 14 is held in the middle of the concave part 530 of the supply valve 13, the urging force of the urging member 14 is transferred to the supply valve 13 securely. The supply valve 13 can seal the insertion opening 26 of the seal member 12 securely. In addition, since the concave part 530 has the internal-side taper part, although the inner diameter of the concave part 530 and the outer diameter of the urging member 14 are substantially the same, it is possible to insert the urging member 14 into the concave part 530 easily when assembling the ink supply section 160.

As described above, according to the present invention, it is possible to assemble the ink supply section 160 easily in comparison to the prior art. Therefore, it is possible to reduce the production time of the ink cartridge 100 and to decrease the production cost of the ink cartridge 100.

Although the present invention has been described by way of exemplary embodiments, it should be understood that those skilled in the art might make many changes and substitutions without departing from the spirit and the scope of the present invention which is defined only by the appended claims.

What is claimed is:

1. A liquid cartridge comprising:

a liquid accommodating chamber for containing a liquid;

a hollow part having a liquid supplying opening, into which a liquid supplying needle of a liquid ejecting apparatus is inserted, while said liquid supplying opening communicating with said liquid accommodating chamber;

a seal member contained in said hollow part, said seal member having an insertion opening being in elastic contact with an external circumference of said liquid supplying needle, while said liquid supplying needle is inserted to said insertion opening;

a supply valve contained in said hollow part, said supply valve arranged in order to close or open said insertion opening of said seal member; and an urging member for urging said supply valve toward said seal member, wherein said supply valve comprises:

a body part having a circular cross-section, and a diameter that is substantially uniform, of which the diameter is substantially the same as a diameter of said hollow part of said liquid supplying part, and having a cylindrical shape, of which a length in a sliding direction is greater than said diameter of said hollow part of said liquid supplying part, the body part being shaped so that the body part can pass through the insertion opening of the seal and then be urged by said urging member to close the insertion opening;

a taper part formed at a first end of said body part, said taper part having an end engaged with said urging member; and a bottom face formed at a second end of said body part, said bottom face having a flat surface being in contact with said seal member when the body part closes the insertion opening.

2. A liquid cartridge as claimed in claim 1, wherein said urging member is a coil spring, and a distance between said taper part engaged with said first end of said coil spring in said hollow part of said liquid supplying part and a spring seat for preventing said second end of said coil spring from moving in said hollow part is longer than said height of said body part of said supply valve, when said bottom face of said supply valve is in contact with said seal member.

3. A liquid cartridge as claimed in claim 1, wherein a diameter of said body part of said supply valve is larger than a diameter of said liquid supplying needle inserted from said liquid supplying opening to allow said supply valve to slide in said hollow part.

4. A liquid cartridge as claimed in claim 1, wherein said urging member is a coil spring, and said supply valve has a concave part for accepting said coil spring to urge said supply valve.

5. A liquid cartridge as claimed in claim 1, wherein said supply valve has a concave part at said first end of said body part.

6. A liquid cartridge as claimed in claim 1, wherein a diameter of said insertion opening of said seal member is smaller than a diameter of said bottom face of said body part of said supply valve.

* * * * *